US008367601B2

(12) United States Patent
Carlson et al.

(10) Patent No.: US 8,367,601 B2
(45) **Date of Patent: *Feb. 5, 2013**

(54) LIQUID CONCENTRATED FABRIC SOFTENER COMPOSITION

(75) Inventors: Jessica Carlson, Hugo, MN (US); Stephen B. Christensen, Inver Grove Heights, MN (US); Robert D. P. Hei, Baldwin, WI (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/486,092

(22) Filed: Jun. 1, 2012

(65) Prior Publication Data

US 2012/0233786 A1 Sep. 20, 2012

Related U.S. Application Data

(63) Continuation of application No. 12/720,357, filed on Mar. 9, 2010, now Pat. No. 8,232,239.

(51) Int. Cl.
*C11D 3/43* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | |
|---|---|---|---|
| 5,039,659 | A | 8/1991 | Narula et al. |
| 5,070,073 | A | 12/1991 | Narula et al. |
| 5,116,520 | A | 5/1992 | Lichtenwalter et al. |
| 5,221,794 | A | 6/1993 | Ackerman et al. |
| 5,223,628 | A | 6/1993 | Whittlinger |
| 5,234,611 | A | 8/1993 | Trinh et al. |
| 5,403,499 | A | 4/1995 | Kiefer et al. |
| 5,476,599 | A | 12/1995 | Rusche et al. |
| 5,500,138 | A | 3/1996 | Bacon et al. |
| 5,501,806 | A | 3/1996 | Farooq et al. |
| 5,503,756 | A | 4/1996 | Corona, III et al. |
| 5,536,421 | A | 7/1996 | Hartman et al. |
| 5,562,847 | A | 10/1996 | Waite et al. |
| 5,643,865 | A | 7/1997 | Mermelstein et al. |
| 5,759,990 | A | 6/1998 | Wahl et al. |
| 5,773,409 | A | 6/1998 | Haq et al. |
| 5,777,046 | A | 7/1998 | Boeckh et al. |

(Continued)

FOREIGN PATENT DOCUMENTS

| | | |
|---|---|---|
| EP | 0 580 245 A2 | 1/1994 |
| EP | 0 580 245 A3 | 5/1996 |

(Continued)

OTHER PUBLICATIONS

"Bosit Perfect" Ecolab Safety Data Sheet (pp. 1-5) and product label (p. 6), and advertisement (p. 7-8); Code: 101787E, Version:3, Date of Issue: Jan. 27, 2006. 8 pages. Conforms to EU Directive 91/155/EEC, as amended by 2001/58/EC—Germany.

(Continued)

*Primary Examiner* — John Hardee
(74) *Attorney, Agent, or Firm* — McKee, Voorhees & Sease, P.L.C.

(57) ABSTRACT

Disclosed are concentrated liquid rinse cycle fabric softener compositions comprising a quaternary ammonium cation and benzylated alcohol solvent having between 50% to 90% weight active ingredients. Benzyl alcohol is disclosed as a preferred solvent to produce a clear liquid solution formulation rather than emulsion. The concentrated liquid rinse cycle fabric softener compositions of the present invention possess desirable stability, sustainability and fabric-softening properties. Methods of use are further described.

18 Claims, 1 Drawing Sheet

U.S. PATENT DOCUMENTS

| | | | | |
|---|---|---|---|---|
| 5,783,534 | A | 7/1998 | Wahle et al. | |
| 5,804,547 | A | 9/1998 | Godfroid et al. | |
| 6,001,797 | A | 12/1999 | Ewbank et al. | |
| 6,037,315 | A | 3/2000 | Franklin et al. | |
| 6,093,336 | A | 7/2000 | Ploumen et al. | |
| 6,110,886 | A | 8/2000 | Scepanski | |
| 6,271,193 | B1 | 8/2001 | Sprecker et al. | |
| 6,531,444 | B1 | 3/2003 | Shefer et al. | |
| 6,652,766 | B1 | 11/2003 | Frankenbach et al. | |
| 6,780,834 | B2 | 8/2004 | Schramm, Jr. et al. | |
| 6,787,510 | B2 | 9/2004 | Santos et al. | |
| 6,825,163 | B1 | 11/2004 | Kvita et al. | |
| 6,884,766 | B2 | 4/2005 | DeClercq et al. | |
| 7,037,887 | B2 | 5/2006 | Frankenbach et al. | |
| 7,071,155 | B2 | 7/2006 | Griese et al. | |
| 7,157,411 | B2 | 1/2007 | Rohde et al. | |
| 7,160,849 | B2 | 1/2007 | Tsumori et al. | |
| 7,632,795 | B2 | 12/2009 | Lupia et al. | |
| 2001/0021692 | A1 | 9/2001 | Mohammadi et al. | |
| 2003/0236181 | A1 | 12/2003 | Chan et al. | |
| 2004/0101505 | A1 | 5/2004 | Payne et al. | |
| 2004/0139990 | A1 | 7/2004 | Wachter et al. | |
| 2005/0060811 | A1 | 3/2005 | Smith et al. | |
| 2005/0096251 | A1 * | 5/2005 | Frankenbach et al. | 510/515 |
| 2005/0227907 | A1 | 10/2005 | Lee et al. | |
| 2008/0307586 | A1 | 12/2008 | Hodge et al. | |
| 2009/0038083 | A1 | 2/2009 | Roselle et al. | |

FOREIGN PATENT DOCUMENTS

| | | | |
|---|---|---|---|
| EP | 0 535 942 | B1 | 2/1999 |
| EP | 1 077 250 | A1 | 2/2001 |
| EP | 0 912 673 | B1 | 4/2003 |
| EP | 0 920 486 | B2 | 10/2004 |
| EP | 0 535 942 | B2 | 11/2004 |
| WO | WO 95/33038 | A1 | 12/1995 |
| WO | WO 98/16538 | A1 | 4/1998 |
| WO | WO 98/17756 | A1 | 4/1998 |
| WO | WO 98/45394 | A2 | 10/1998 |
| WO | WO 98/45394 | A3 | 10/1998 |
| WO | WO 98/47991 | A1 | 10/1998 |
| WO | WO 99/06509 | A1 | 2/1999 |
| WO | WO 01/14313 | | 3/2001 |
| WO | WO 02/081611 | | 10/2002 |
| WO | WO 2004/000016 | A2 | 12/2003 |
| WO | WO 2004/000016 | A3 | 12/2003 |
| WO | WO 2007/096790 | A1 | 8/2007 |

OTHER PUBLICATIONS

International Search Report mailed Feb. 6, 2012, Ecolab USA Inc. et al., PCT/IB2011/050958 filed Mar. 7, 2011.

* cited by examiner

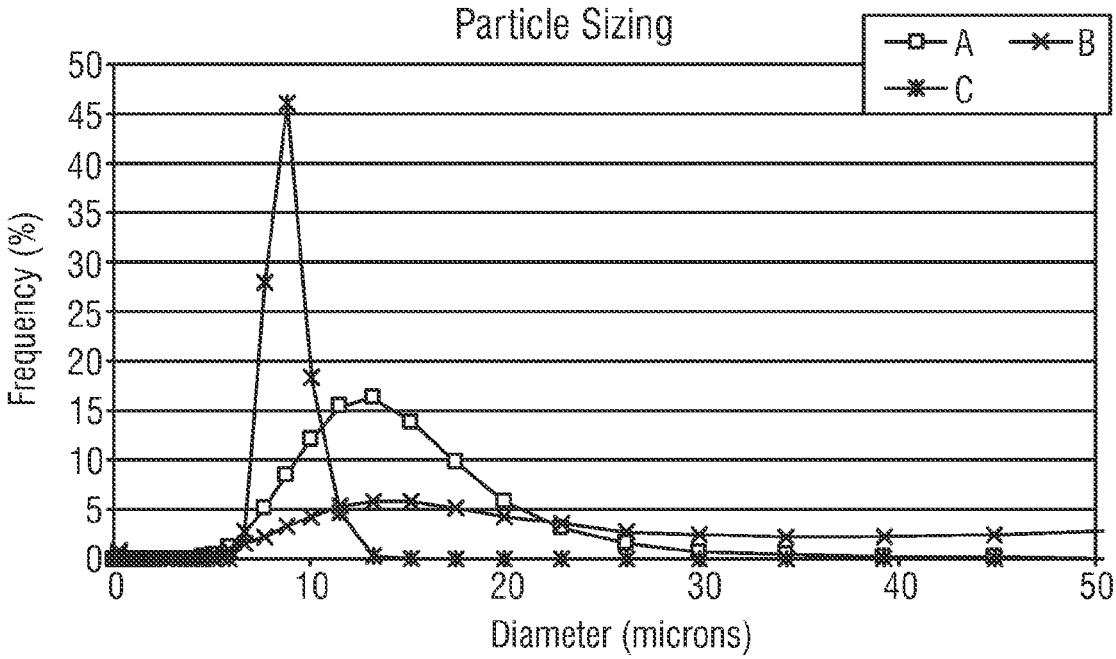
Particle Sizing
A
B
C
Frequency (%)
50
45
40
35
30
25
20
15
10
5
0
0
10
20
30
40
50
Diameter (microns)

LIQUID CONCENTRATED FABRIC SOFTENER COMPOSITION

CROSS-REFERENCE TO RELATED APPLICATIONS

This is a Continuation application of U.S. Ser. No. 12/720,357 filed Mar. 9, 2010, now U.S. Pat. No. 8,232,239 herein incorporated by reference in its entirety.

FIELD OF THE INVENTION

The invention relates to concentrated liquid rinse cycle fabric softener compositions and methods for using the same. In particular, the invention relates to a fabric softener composition containing a quaternary ammonium cation and preferably the solvent benzyl alcohol to produce a concentrated liquid solution formulation. The liquid solution provides a highly concentrated product with between 50% to 90% weight active ingredients.

BACKGROUND OF THE INVENTION

Various types of fabric-softening or conditioning agents are known for use as fabric treatment compositions. Numerous compositions are formulated as aqueous dispersions due to the use of water-insoluble softening agents and solvents. Most often, the fabric softening agents comprise large amounts of water and far lesser amounts of fabric-softening agents and other optional ingredients For example, it is common for fabric softening agents to comprise from about 3 to about 25% by weight of a quaternary ammonium compound to be added to either the wash or rinse cycle of a commercial or home laundering operation. Alternatively, fabric treatment compositions may be formulated as solid carriers, such as dryer activated or dryer-added, rather than liquid carriers. See U.S. Pat. No. 3,442,692. Regardless of the liquid or solid formulations of the fabric-softening agents, quaternary ammonium compounds are often used for the formulations. Use of quaternary ammonium compounds for liquid formulations present formulation difficulties in producing stable dispersions or solutions. There are a myriad of possible compounds for highly concentrated liquid fabric softening compositions, however, no guiding principles have been developed to predict compositions having improved fabric-softening performance at increased concentrations, improved stability and reduced viscosity.

Consumer acceptance of fabric-softening or conditioning agents is largely determined upon the product's performance effectiveness and ease of use. Additionally, environmental concerns for development of highly sustainable (i.e., biodegradable) products as well as the cost of a product is also important to many consumers. Accordingly, product formulation in a cost-effective manner is critical for providing effective fabric-softening or conditioning agents. Therefore, there is a need for development of highly sustainable and highly concentrated compositions to meet these consumer needs. Additionally, an increase in a product's concentration reduces necessary packaging and decreases shipping costs on a per unit basis.

Accordingly, it is an object of the invention to develop a fabric softener composition having a high percentage of weight active components.

Additionally, it is an object of the claimed invention to develop a premium rinse cycle fabric softener composition that is highly concentrated.

A further object of the invention is to develop a concentrated liquid fabric softener that contains the solvent benzyl alcohol.

A specific object of the invention is to develop a highly concentrated fabric softener composition to enhance sustainability and minimize shipping expenses.

A specific object of the invention is to further develop a highly concentrated fabric softener composition that readily and evenly disperses into the water phase of a wash wheel with no, or minimal, mixing; and without gelling or clumping into solution or onto the treated articles.

A further object of the invention includes a fabric-softening compositions stable as a clear solution.

BRIEF SUMMARY OF THE INVENTION

Disclosed are concentrated liquid rinse-cycle fabric softener compositions comprising a quaternary ammonium cation and solvent having between 50% to 80% weight active ingredients. Benzyl alcohol is disclosed as a preferred solvent to produce a clear liquid solution formulation rather than emulsion. The concentrated liquid rinse cycle fabric softener compositions of the present invention possess desirable stability, sustainability and fabric-softening properties for conditioning fabrics during the rinse cycle of residential or industrial and institutional laundering operations.

BRIEF DESCRIPTION OF THE DRAWINGS

FIG. 1 shows comparative testing of fabric softener compositions with the liquid rinse-cycle fabric softener composition of the present invention, namely the ability to readily disperse with an effective particle size.

DETAILED DESCRIPTION OF THE PREFERRED EMBODIMENT

The liquid concentrated fabric softener compositions according to the embodiments of the invention present a significant improvement in the prior art, namely providing a highly sustainable concentrated product. The increase in product sustainability and product concentration results in a significant reduction in shipping and transportation expenses as compared to less concentrated products. The liquid concentrated fabric softener composition according to the invention provides a highly concentrated product overcoming the inefficiency of prior art products incapable of having increased concentration and percentage of weight active components while maintaining a stable and uniform liquid solution or dispersion. For example, the liquid concentrated fabric softener compositions according to the invention are readily and evenly dispersed into the water phase of the wash wheel with no, or minimal, mixing. In addition, liquid concentrated fabric softener compositions do not gel or clump into solution or onto treated articles. This is distinct from other premium softener products that may reach weight percentages of active components as high as 25%. However, further concentration of the products are unsuccessful as gellation often results in a non-pumpable and highly viscous product.

The liquid concentrated fabric softener composition according to the present invention demonstrates a highly concentrated product having at least a two to three time increase in concentration over commercially-available products. Preferably, the liquid concentrated fabric softener composition demonstrates percentages of weight active ingredients as great as 50%-60%, preferably 60%-70% and most preferably as great as at or above 80%. The development of such highly concentrated liquid fabric softener compositions provides numerous benefits, including, decreased shipping expenses and development of a highly concentrated product that maintains pumpability for ease in dispensing of the composition. The highly concentrated composition comprises little water. This distinguishes the present composition from emulsions which are readily dispersed in water. The highly concentrated liquid fabric softener according to the invention comprises a solution of either a semi-solid, or a soluble or sheer-thinning gel, or a liquid softening agent with a suitable solvent. According to the invention, the solvent is provided in sufficient quantity to maintain a clear pumpable solution. According to a preferred embodiment, the viscosity of the pumpable liquid fabric softener is below 2000 centipoise (cP) at ambient temperature, providing an easily dispensable composition. The liquid fabric softener compositions are effective at softening fabrics in both soft and hard water and may be provided in ready-to-use, i.e., without dilution, or may be diluted with water prior to adding to the washing machine (e.g., a rinse cycle dispenser).

According to a preferred embodiment, the softening agent for the liquid fabric softener composition is preferably a quaternary ammonium compound or quaternary ammonium cation compound, commonly referred to as a quat. Exemplary quaternary ammonium compounds that may be used as softening agents include, for example, alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Various exemplary quaternary ammonium compounds useful as softening agents are described herein. For example, exemplary alkylated quaternary ammonium compounds include ammonium compounds having an alkyl group containing between $C_6$-$C_{24}$. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group. Further, exemplary ring or cyclic quaternary ammonium compounds include imidazolinium quaternary ammonium compounds, such as methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis(2-tallow, 1-methyl, imidazolinium-methyl sulfate). Still further, exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. Further, the alkyl group can contain between about 6 and about 24 carbon atoms, and can contain between about 10 and about 18 carbon atoms, and can be a stearyl group or a hydrogenated tallow group. Aromatic quaternary ammonium compounds can include multiple benzyl groups. Exemplary alkoxylated quaternary ammonium compounds include methyldialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about $C_6$-$C_{24}$ and the alkoxy groups can contain between about 1 and about 50 alkoxy groups units wherein each alkoxy unit contains between about $C_2$-$C_3$. Exemplary amidoamine quaternary ammonium compounds may include methyl-bis(tallow amidoethyl)-2-hydroxyethyl ammonium methyl sulfate, methyl bis(oleylamidoethyl)-2-hydroxyethyl ammonium methyl sulfate, and methyl bis(hydrtallowamidoethyl)-2-hydroxyethyl ammonium methyl sulfate.

The quat utilized in the liquid fabric softener composition according to the present invention is preferably a sustainable product having at least a minimal level of biodegradation and that is suitable for formulation with a solvent providing a highly concentrated product. The softening quat used herein may be selected from known quat fabric softening compounds such as those described herein. According to a preferred embodiment, a diquaternary ammonium compound is the softening agent according to the invention. Diquaternary ammonium compounds include those compounds having at least two quaternary ammonium groups. According to a further preferred embodiment, an alkanolamine diquaternary ammonium compound is used for the softening agent according to the invention, such as a triethanolamine (TEA) diquaternary ammonium. There are numerous effective quat softening agents available, such as for example, triethanolamine (TEA) diamido quaternary ammonium compounds, available under the name Accosoft 501™, Accosoft 780 PG™ or Evonik LM 222™. However, due to a demonstrated increased rate of biodegradation such TEA diamido quats are not sufficiently sustainable for the liquid fabric softener composition according to the invention.

Therefore, according to a further preferred embodiment of the invention, a sustainable diester quat is the preferred softening agent for the highly concentrated liquid fabric softener composition. Exemplary ester quaternary compounds are available under the name Stepantex™. A preferred diester quat softening compound may have the general formula:

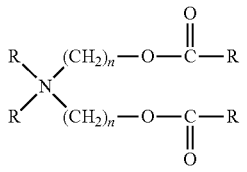

where R may independently represent for example an aliphatic hydrocarbon group, alkyl, alkoxyl or hydroxyl groups or $(CH_2)_x$—R wherein R represents an alkoxy carbonyl group, benzyl, phenyl, alkyl substituted phenyl, OH or H; and n may independently represent an integer greater than 1. It is also understood that the substituents R may be substituted with various groups as readily ascertained by a person of ordinary skill in the art to comprise a diester quat providing fabric-softening properties according to the invention.

According to a preferred embodiment of the invention, a sustainable TEA diester quat is preferred as the softening agent for the liquid fabric softener composition. Examples of commercially-available suitable TEA diester quats are available for example under the names Stepantex™ is Stepantex DC-90™, Stepantex VT-90™ or Stepantex SP-90™. Use of the diester quat provides at least the same effectiveness as a fabric softener as the nonsustainable commercial emulsion products with the additional benefit of formulation into the inventions highly concentrated liquid fabric softener composition. The TEA diester quat according to the invention may be utilized as either a semi-solid or an already free-flowing liquid diester quat to formulate the highly concentrated liquid fabric softener composition according to the invention. In addition, the TEA diester quat may also be formulated as either vegetable-based or tallow-based.

According to a further embodiment, the quaternary ammonium compound utilized as the softening agent according to the invention may include any counter ion that allows the component to be used in a manner that imparts fabric-softening properties. Exemplary counter ions include chloride, methyl sulfate, ethyl sulfate, and sulfate. One skilled in the art may further prepare quaternary ammonium cation softening agents, such as those described herein, through esterification and quaternization reactions, using commercially-available materials, for example as disclosed in U.S. Pat. No. 4,137,180. For example, ester quats according to preferred embodiments of the invention may be obtained by quaternizing fatty triethanolamine esters. See U.S. Pat. No. 6,037,315.

The highly concentrated liquid fabric softener composition according to the invention is formulated with a solvent and a quat, preferably a diester quat, more preferably a TEA diester quat, to produce a concentrated liquid solution rather than an emulsion. A solvent is used in the concentrated liquid fabric softener composition to create a solution with the softening agent. The solvent according to the invention must be compatible with either a liquid or semi-solid softening agent having a melting point of about 90° F. More preferably, the solvent and softening agent produce a clear liquid that remains in solution rather than allowing the softening quat to settle out of the formulation. However, excess solvent is undesirable in terms of sustainability. According to a preferred embodiment, a semi-solid TEA diester quaternary ammonium compound is utilized as the softening agent and a solvent is selected to maintain the quat in a solution rather than a dispersion or emulsion.

Various solvents are known by those of ordinary skill in the art, including for example, ethanol, propanol, isopropanol or butanol, propylene glycol, dipropylene glycol, dipropylene glycol methyl ether and other glycol ethers. Additionally, solvents are often combined with additional liquid carriers, such as water. According to a preferred embodiment the solvent according to the highly concentrated fabric softener is an organic solvent. The organic solvent according to the present invention preferably has low volatile organic compound (VOC) content and is capable of formulation in a sustainable, highly concentrated fabric softener composition. Preferably the VOC is less than about 10 mm-Hg, preferably less than 5 mm-Hg, often less than 1 mm-Hg.

According to the invention, the preferred solvents for creating a concentrated solution of softening agent is a benzylated alcohol, such as for example benzyl alcohol, 1-phenylethanol, 1-phenyl-1-propanol, 2-phenylethanol or related analogs, with the most preferred being benzyl alcohol. Benzyl alcohol is a phenyl substituted alkyl alcohol. It is preferred for the formulation of the highly concentrated fabric softener composition due to its desirable characteristics. For example, benzyl alcohol demonstrates low toxicity and has low vapor pressure preventing its evaporation from the fabric softener composition according to the invention. Further, the use of benzyl alcohol as the solvent for the softening agent preferably maintains a clear liquid composition according to the invention. According to an alternative embodiment of the invention, benzylated alcohol solvents may further be utilized as the solvent for the highly concentrated fabric softener. According to an embodiment, suitable softening agent to solvent ratios include from 80:10 to 50:50, preferably 60:40 to 70:30 of softening agent to solvent.

In addition to the softening agent and solvent according to the liquid rinse cycle fabric softener composition, a silicone is preferably included in the composition. The inclusion of the silicone is preferably added with the softening quaternary ammonium cation to minimize yellowing often caused by the softening quat, as primarily observed in the industrial and institutional sectors due to the high alkalinity and temperature conditions. U.S. patent application Ser. No. 12/138,021. The addition of a silicone to the highly concentrated fabric softener compositions according to the invention reduces the yellowing and dulling of fabrics without adversely affecting the softening properties. However, formulation of a fabric-softening composition comprising a silicone and a softening quat presents difficulty as silicones are not readily soluble in softening quats.

The silicone of the concentrated liquid fabric softener composition can be a linear or branched structured silicone polymer. The silicone of the present invention can further be a single polymer or a mixture of polymers. According to a preferred embodiment, the silicone utilized in the concentrated liquid fabric softener composition is an amino-functional silicone, also referred to as an aminosilicone. The amino-functional silicone of the invention can be a linear or branched structured amino-functional silicone polymer and can further be a single polymer or a mixture of polymers, including a mixture of polymers wherein one of the polymers contains no amino functionality, e.g., a polydimethylsiloxane polymer. An exemplary aminosilicone is a high molecular weight polysiloxane that is available as Wacker FC-201™. Further suitable amino-functional silicones are available from Wacker and include Wacker RFC 203™ which is an amino functional silicone with polyether groups.

Suitable liquid fabric softener compositions are set forth below with preferred ranges of the compositions also set forth:

| Liquid Fabric Softener Composition | Wt % | Preferred Wt % |
|---|---|---|
| Quat Softening Agent | 50-90% | 60-70% |
| Solvent | 10-50% | 30-40% |
| Silicone | 0-15% | 1-10% |

These percentages can refer to percentages of a commercially available concentrated fabric softener composition, which may further comprise a variety of other materials useful in a commercial fabric softener composition to enhance either the appearance and/or performance of the fabric softener composition. Compatible adjuvants that can be added to the compositions herein for their known purposes, include for example, solvents, dyes, anti-yellowing agents, dispersants, dryer reduction aids, anti-static agents, anti-wrinkling agents, viscosity control agents, emulsifiers, preservatives, antioxidants, bactericides, fungicides, surfactants, soil release agents, brighteners, opacifiers, freeze-thaw control agents, pH adjusters, perfumes, colorants and others. U.S. Pat. Nos. 4,103,047 and 5,562,847; U.S. application Ser. No. 12/138,021 Those skilled in the art will appreciate other suitable components and concentrations for obtaining comparable highly concentrated liquid fabric softening compositions having equivalent softening properties. These and other known compatible adjuvants, if used, are added at their usual levels, generally each of up to about 5% by weight of the preferred liquid fabric softener composition.

According to an embodiment of the invention, the highly concentrated liquid fabric softener composition is formulated at a preferred pH range for shelf stability between about 3 and about 8. The pH is dependent upon the specific components of the composition of the invention. Fabric softener compositions containing quaternary ammoniums compounds operate well near neutral pH. According to a preferred embodiment formulated with an ester quaternary ammonium compound as the softening agent, the preferred pH is lower because the ester linkages may break with higher pHs. As such, it is preferred that compositions of the invention that include ester quaternary ammoniums have a pH in the range of between about 3 and about 6, more preferably in the range of between about 4 and about 5.

As a result of many cationic polymers decomposing at high pH, especially when they contain amine moieties, it is desirable to keep the pH of the composition below the $pK_a$ of the amine group that is used to quaternize the selected polymer, below which the propensity for this to occur is greatly decreased. This reaction can cause the product to lose effectiveness over time and create an undesirable product odor. As such, a reasonable margin of safety, of 1-2 units of pH below the $pK_a$ should ideally be used in order to drive the equilibrium of this reaction to strongly favor polymer stability. Although the preferred pH of the product will depend on the particular cationic polymer selected for formulation, typically these values should be below about 6 to about 8.5. The pH of the composition can be adjusted by the addition of a pH adjuster. For example, an acidic pH adjuster, such as acetic acid, glycolic acid, methyl sulfonic acid, sulfamic acid, or citric acid, may be added to lower the pH of the textiles being laundered to approximately 5-6.

The fabric softener composition according to the invention may further comprise souring agents that neutralize residual alkaline that may be present on the fabric. The souring agents can be used to control the pH of the fabric. The souring agents can include acids such as saturated fatty acids, dicarboxylic acids, and tricarboxylic acids. The souring agents can include mineral acids such as hydrochloric acid, sulfuric acid, phosphoric acid, and HFS acid.

According to embodiments of the invention, optional wetting agents or surfactants may be included in the composition. Preferably, surfactants utilized in the concentrated liquid fabric softener composition include those selected from water soluble or water dispersible nonionic, semi-polar nonionic, anionic or any combination thereof. A representative listing of the classes and species of surfactants as may be useful herein for the fabric softener composition appears in U.S. Pat. No. 3,664,961. According to an additional embodiment of the invention, stabilizers can be present in the composition to ensure stability under storage conditions for the compositions. Stabilizing agents may include: antioxidants, such as ascorbic acid, propyl gallate and citric acid; and reductive agents, such as sodium borohydride and hypophosphorous acid.

According to an embodiment of the invention, the highly concentrated liquid fabric softener composition is especially suitable for use in the rinse cycle of a fabric laundering operation. Therefore, the composition according to the invention is administered to a washing machine rather than to a dryer unit. The highly concentrated liquid fabric softener composition may be used in either residential washing machines or in industrial and institutional settings. The terms "industrial and institutional" as used herein refer to fabric or textile laundering operations in the commercial or service industries, including for example, hotels, motels, hospitals, nursing homes, restaurants, health clubs, and the like. Accordingly, the highly concentrated liquid fabric softener composition according to the invention is suitable for use in either residential or industrial and institutional settings where fabric is often exposed to harsher conditions compared to the consumer or residential sector. For example, fabrics laundered in industrial and institutional settings are often subject to higher amounts of soil requiring harsher detergents, processed with higher volumes of laundry in shorter times and processed at significantly higher temperatures in a dryer unit. According to the invention, the fabric-softening compositions effectively condition and soften treated fabrics without yellowing or dulling of the fabric in both consumer and industrial sectors.

According to a further embodiment of the invention, the composition is not a soft detergent, as the highly concentrated liquid fabric softener composition is a separate composition from the detergent and applied during the final rinse cycle. The composition allows for flexible dosing to provide user-specific desired levels of softness when added to cold, warm or hot rinse water, as selected by the user.

The fabric softener composition according to the invention is provided in a highly concentrated liquid composition. However, numerous formulation embodiments can be produced according to the invention. The fabric softener composition can be provided for dilution prior to the laundering process; alternatively, the composition can take the form of a fabric softener intended to be applied to articles without substantial dilution and sold as any form known to those skilled in the art as a potential medium for delivering such fabric softeners. For example, sprays, including aerosol or pump sprays, for direct application to fabrics are considered within the scope of the invention. One skilled in the art will recognize the methods for making highly concentrated liquid fabric softener compositions according to the embodiments of the invention. For example, methods of low shear mixing are utilized to make the compositions according to the invention. Additional variations and alternative embodiments will be readily ascertained by a skilled artisan based on the disclosure of the present invention.

The embodiments of this invention are not limited to particular liquid concentrated fabric softener compositions, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities refers to variation in the numerical quantity that can occur.

The terms "fabric softener" and "fabric conditioner" as used herein, refer to both commercial and industrial products added to the wash or rinse cycle of a laundry process for the express or primary purpose of conferring one or more conditioning benefits. It is to be understood by those skilled in the art that numerous fabrics and laundry can be processed according to the invention, including any textile or fabric material that can be processed in a commercial and/or industrial washer and dryer for the removal of soils and water. Although the invention is described in the context of conditioning "fabrics," one skilled in art shall understand that various other items and articles that include fabric can similarly be treated. Additionally, it should be understood that various types of fabrics, laundry and textiles can be conditioned according to the invention, including for example, natural, synthetic and inorganic fibers and mixtures of the same.

The terms "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

A blend of various glycol-based solvents was analyzed to determine compatibility with the fabric softener composition according to the invention. The glycol-based solvents studied below are based upon those used in the prior art as exemplar solvents, including for example 2,2,4-trimethyl-1,3-pentanediol, 1,2-hexanediol, 2-ethyl-1,3-hexanediol, cocamide 6EO, canola fatty acid, 2,4-cyclohexyl dimethanol, $C_{9-11}EO_8$, benzyl benzoate and water. See e.g., U.S. Pat. No. 6,521,589. As the results indicate, the use of the various solvents with the concentrated product did not produce a clear, stable, highly concentrated, liquid composition.

| | % Inclusion by Weight | | | | | |
|---|---|---|---|---|---|---|
| Ingredient | 1 | 2 | 3 | 4 | 5 | 6 |
| Stepantex SP-90* | 70.8 | 72.8 | 66.7 | 66.7 | 70.0 | 70.0 |
| 2,2,4-trimethyl-1,3-pentanediol | 15.6 | | 13.0 | 23.0 | | |
| 1,2-hexanediol | 8.0 | 11.7 | | | 30.0 | |
| 2-ethyl-1,3-hexanediol | | | | | | 30.0 |
| Ninol C-5 (cocamide 6EO) | 4.1 | | | | | |
| Coconut FA (Kortacid) | 1.5 | | | | | |
| 1,4-cyclohexyl dimethanol | | 8.0 | | | | |
| Tomadol 91-6 ($C_{9-11}EO_8$) | | 7.5 | | | | |
| benzyl benzoate | | | 1.5 | 1.5 | | |
| water | | | 18.8 | 8.8 | | |
| Physical Characteristics | Solid, opaque white | Chunky/ Globular texture, opaque white | Chunky/ Globular texture, opaque white | Chunky/ Globular texture, opaque white | Flowable, but opaque white in color | Flowable, but opaque white in color |

*10% IPA

Example 2

The solvent benzyl alcohol was tested against ethanol and isopropanol as a solvent for a highly concentrated rinse cycle fabric softener composition. The table below shows the results of blending the TEA diester quat softening agent Stepantex SP-90 at various ratios with the solvents ethanol, isopropanol, and benzyl alcohol.

| Stepantex SP-90* | Ethanol | IPA | Benzyl Alcohol | Results |
|---|---|---|---|---|
| 90 | 10 | | | Solid, non-flowing, opaque white. |
| 80 | 20 | | | Solid, non-flowing, opaque white. |
| 70 | 30 | | | Solid, non-flowing, opaque white. |
| 60 | 40 | | | Solid, non-flowing, opaque white. |
| 90 | | 10 | | Solid, non-flowing, opaque white. |
| 80 | | 20 | | Solid, non-flowing, opaque white. |
| 70 | | 30 | | Solid, non-flowing, opaque white. |
| 60 | | 40 | | Solid, non-flowing, opaque white. |
| 90 | | | 10 | Slightly flowing, opaque white. |
| 80 | | | 20 | Slow-flowing, cloudy light yellow. |
| 70 | | | 30 | Free-flowing, slightly cloudy light yellow. |
| 60 | | | 40 | Free-flowing, completely clear light yellow. |

As demonstrated in the table above, the clarity of the concentrated fabric softener composition was further observed for a preferred clear liquid solution. As shown, increases in concentration of the liquid fabric softening composition often have negative effects on the viscosity and appearance of the compositions.

Example 3

The dispersability of the liquid fabric softening composition into a wash solution according to the invention was compared to other fabric softening compositions. The particle sizes of the fabric softening compositions in the dispersions were further measured, as the softening performance of a softener depends at least in part on the particle size of the active ingredients in an aqueous use solution. If a particle size is too large, then the efficiency of the softener will decrease as less of the treated surface is covered by the softening composition.

With conventional fabric softening compositions, the particle size is established during its formulation process using high-shear mixing of the softening quat in hot water. The typical particle size of such fabric softening compositions is between about 5 and 15 microns.

According to the present invention, for the concentrated liquid fabric softening composition to be effective it must be readily dispersable in water with a particle size between about 5 and 15 microns using only the agitation from the wash cycle (as no high-shear mixing conditions exist). FIG. 1 shows the particle size distributions for two comparative fabric softening compositions as well as the liquid fabric softening composition according to the invention (determined using a Horiba™ particle size unit).

Sample A is a comparative sample of a blend of the liquid diester softening quat Stepantex DC-90 with two dispersant aids (Stepantex DC 90, 71.43%; Surfadone LP-100. 14.29%; Carspray 300, 14.38%). The Sample A formulation was mixed gently with water, whereupon the formulation readily dispersed into dispersion with a peak in the particle size distribution of about 13 microns. Sample B is a concentrated liquid fabric softening composition according to the invention (Stepantex SP-90, 78.4%; Benzyl Alcohol, 19.6%; Tomamine E14-2, 2%). The Sample B formulation was mixed gently with water, whereupon it readily dispersed to give a dispersion with a peak in the particle size distribution of about 14 microns. Sample C is a commercially available emulsion-type fabric softener available from Ecolab® as Clearly Soft™. Sample C has a peak in the particle size distribution at about 9 microns.

FIG. 1 shows the differences between the three Samples A, B and C are minor, demonstrating that the liquid concentrate of the present invention is capable of readily dispersing in order to give a use solution with an effective particle size.

Example 4

The fabric-softening ability of the highly concentrated rinse cycle fabric softener composition according to the invention was tested in comparison to the Samples A and C described in Example 3. The compositions were tested according to the process described in U.S. patent application Ser. No. 12/138,021. First, new white cotton terry towels were scoured to remove any residual manufacturing treatments. For each sample, 18 lbs of towels were washed using an alkaline detergent, followed by chlorine bleach. The towels were then treated in the final rinse step with an amount of softener to deliver 12.0 g of active softener and 2.4 g of Wacker FC-201 aminosilicone. As described in U.S. patent application Ser. No. 12/138,021, the function of the aminosilicone is to help with both yellowing and absorption of the linen.

For Sample C, the testing required 60 grams of Clearly Soft™, including both the softening quat and the silicone. For Sample B this was 17.0 grams of the SP-90/benzyl alcohol blend, along with 2.4 g of Wacker FC-201. For Sample A this amount was 18.7 g of the DC-90 blend along with 2.4 g of Wacker FC-201. After washing, the towels were dried in an electric dryer at about 220° F. For each of the three formulation samples a different set of towels was treated to a series of five cycles of washing and softening using that formulation.

Panel tests were performed in which five participants were asked to rate the softness of the towels on a scale of 1 to 7 (1 being harsh and 7 being most soft). For convenience the panel test was divided into two parts, with the first test comparing the softness resulting from Sample C (commercial Clearly Soft™) with the softness available from Sample B of the present invention (using a solution of semi-solid SP-90 in benzyl alcohol). The second test compared the softness resulting from Sample C (commercial Clearly Soft™) with the softness available from comparative Sample A (blend of liquid softening quat DC-90 with dispersants). Due to differences in ambient humidity the score for a given sample can vary from day-to-day by up to one softness unit, but the use of a head-to-head comparison of Sample C vs. Sample A on one day and Sample C vs. Sample B on another allows a comparison of Sample B with Sample A.

Panel Test 1

| | Sample | |
|---|---|---|
| Panelist | C | B |
| 1 | 5 | 5 |
| 2 | 5 | 5 |
| 3 | 5 | 5.5 |
| 4 | 5 | 5.5 |
| 5 | 5 | 6 |
| Score | 5.0 | 5.4 |

| Panel Test 2 | | |
|---|---|---|
| | Sample | |
| Panelist | C | A |
| 1 | 4 | 1.5 |
| 2 | 4 | 2 |
| 3 | 4 | 3 |
| 4 | 4 | 2.5 |
| 5 | 4 | 3 |
| Score | 4.0 | 2.4 |

The results of Panel Test 1 demonstrate that the concentrated liquid softener according to the invention (Sample B), using a semi-solid softening quat, is capable of delivering softness at least as good as a typical emulsion-type fabric softener such as Sample C (Clearly Soft™). The result of Panel Test 2 indicates the softening results when using a liquid softening quat as in Sample A are inferior to the softening seen when using a typical emulsion-type fabric softener such as Sample C (Clearly Soft™).

As the average particle size distributions of Samples B and A were similar, this difference is expected to result from the inherent softening ability of the two quats. This points out the benefit of the present invention in being able to use benzyl alcohol to formulate a pumpable liquid out of a semi-solid quat as opposed to the use of a more readily formulated already liquid quat with inferior softening capability. The results further demonstrate the beneficial formulation of the present invention in combining an amino-silicone quat.

What is claimed:

1. A liquid fabric softening composition comprising:

from about 60% to about 80% by weight of a quaternary ammonium cation softening agent; and from about 20% to about 40% by weight of a benzylated alcohol solvent selected from the group consisting of benzyl alcohol, 1-phenylethanol, 1-phenyl-1-propanol, and 2-phenylethanol, wherein said liquid fabric softening composition is a non-emulsion, liquid solution that includes less than about 10% by weight water.

2. The composition of claim 1 wherein said quaternary ammonium cation softening agent is a diester quat.

3. The composition of claim 2 wherein said diester quat is a triethanolamine diester quat.

4. The composition of claim 1 wherein said benzylated alcohol solvent is benzyl alcohol.

5. The composition of claim 1 further comprising an aminosilicone.

6. The composition of claim 1 further comprising at least one of anti-static agents, anti-wrinkling agents, dye transfer inhibition/color protection agents, odor removal/odor capturing agents, soil shielding/soil releasing agents, ultraviolet light protection agents, fragrances, sanitizing agents, disinfecting agents, water repellency agents, insect repellency agents, anti-pilling agents, souring agents, mildew removing agents, enzymes, allergicide agents, starch agents, bleaching agents, optical brightness agents, aminosilicones, and mixtures thereof.

7. The composition of claim 1 wherein said quaternary ammonium cation softening agent is a semi-solid at room temperature.

8. The composition of claim 1 wherein said softening composition is readily dispersible in water.

9. The composition of claim 8 wherein said softening composition softens at least as well as a dispersion-type softening composition.

10. A concentrated liquid fabric softening composition comprising:

from about 60% to about 80% by weight of a quaternary ammonium cation softening agent;

from about 20% to about 40% by weight of a benzylated alcohol solvent selected from the group consisting of benzyl alcohol, 1-phenylethanol, 1-phenyl-1-propanol, and 2-phenylethanol; and from about 1% to about 15% by weight of an aminosilicone agent, wherein said concentrated liquid fabric softening composition is a non-emulsion, liquid solution that includes less than about 10% by weight of water.

11. The composition of claim 10 wherein said quaternary ammonium cation softening agent is a semi-solid at room temperature and is readily dispersible in water.

12. The composition of claim 11 wherein said quaternary ammonium cation softening agent is a triethanolamine diester quat.

13. The composition of claim 10 wherein said benzylated alcohol solvent is benzyl alcohol.

14. The composition of claim 10 wherein said concentrated softening composition softens at least as well as a dispersion-type softening composition.

15. The composition of claim 10 further comprising at least one of anti-static agents, anti-wrinkling agents, dye transfer inhibition/color protection agents, odor removal/odor capturing agents, soil shielding/soil releasing agents, ultraviolet light protection agents, fragrances, sanitizing agents, disinfecting agents, water repellency agents, insect repellency agents, anti-pilling agents, souring agents, mildew removing agents, enzymes, allergicide agents, starch agents, bleaching agents, optical brightness agents, aminosilicones, and mixtures thereof.

16. A method of conditioning fabric, comprising:

washing fabric;

contacting said fabric with a concentrated liquid fabric softening composition comprising from about 60% to about 80% by weight of a quaternary ammonium cation softening agent that is readily dispersable in water, from about 20% to about 40% by weight of a benzylated alcohol solvent selected from the group consisting of benzyl alcohol, 1-phenylethanol, 1-phenyl-1-propanol, and 2-phenylethanol, and less than about 15% by weight of an amino-functional silicone, wherein said concentrated liquid fabric softening composition is a non-emulsion, liquid solution that includes less than about 10% by weight of water; and drying said fabric.

17. The method of conditioning fabric according to claim 16 wherein said quaternary ammonium cation softening agent is a triethanolamine diester quaternary ammonium cation and said benzylated alcohol solvent is benzyl alcohol.

18. The method of conditioning fabric according to claim 16 wherein said concentrated liquid fabric softening composition softens at least as well as a dispersion-type softening composition.

* * * * *